United States Patent [19]

Matthews et al.

[11] 4,355,700

[45] Oct. 26, 1982

[54] MODULAR STAIRWAY SYSTEM FOR INSTALLATION ON STRUCTURES HAVING NON-LINEAR WALLS

[76] Inventors: Wesley D. Matthews; Floyd G. Matthews, both of R.R. 1, Mechanicsburg, Ill. 62545

[21] Appl. No.: 235,089

[22] Filed: Feb. 17, 1981

[51] Int. Cl.[3] ..... E06C 9/02; E04F 11/00

[52] U.S. Cl. ..... 182/83; 182/93; 182/106; 182/178; 52/187

[58] Field of Search ..... 182/93, 83, 178, 113, 182/194, 128, 82, 106; 52/182, 183, 187

[56] References Cited

U.S. PATENT DOCUMENTS

| | | | |
|---|---|---|---|
| 2,085,839 | 7/1937 | Van Dyke | 182/93 |
| 2,593,683 | 4/1952 | Lyons | 182/178 |
| 2,867,855 | 1/1959 | Xanten | 52/182 |
| 3,307,653 | 3/1967 | Gnehm | 182/178 |
| 3,698,511 | 10/1972 | Dohan | 182/178 |
| 3,818,671 | 6/1974 | Matsushita | 182/178 |
| 3,995,832 | 12/1976 | Wiese | 52/183 |
| 4,118,816 | 10/1978 | Mittag | 52/182 |
| 4,143,740 | 3/1979 | Matthews | 182/93 |

FOREIGN PATENT DOCUMENTS

| | | | |
|---|---|---|---|
| 1112623 | 10/1956 | Fed. Rep. of Germany | 52/187 |

*Primary Examiner*—Renaldo P. Machado
*Attorney, Agent, or Firm*—Kirkland & Ellis

[57] ABSTRACT

This application discloses a modular stairway system for circular structures or other structures having non-linear walls. The invention comprises a plurality of first stringer means with a plurality of first connecting means integral to said first stringer means for joining the first stringers, a plurality of second stringer means horizontally spaced from and parallel to the first stringer means with a plurality of adjustable second connecting means integral to said second stringer means for adjustably joining the second stringers such that the first and second stringers conform to the curvature of the structure. A plurality of stairs are horizontally interposed between the first and second stringers, and a stair mounting means for securing the stairs to the first and second stringers are provided. Also provided are mounting means securing the first stringers to the structure and for supporting the second stringer to the structure, whereby there is obtained a reversible sectional stairway system which can be easily installed on circular structures or other structures having non-linear walls.

7 Claims, 12 Drawing Figures

MODULAR STAIRWAY SYSTEM FOR INSTALLATION ON STRUCTURES HAVING NON-LINEAR WALLS

BACKGROUND OF THE INVENTION

1. Field of the Invention

This invention relates to a modular stairway system and more particularly relates to a reversible sectional stairway system which can be easily assembled and installed on circular structures of different diameters or on other structures having non-linear walls.

2. Description of the Prior Art

It has heretofore been considered impractical to prefabricate stairways for circular structures because of the large range of diameters and therefore different radii of curvature. In addition, previous attempts to prefabricate individual components have usually required custom installation on the structure. This custom installation has usually involved welding of the individual components, both together and to the structure. Such stairways also demonstrated the disadvantage of being principally supported by the welds on the wall of the structure. Furthermore, the significant amount of labor involved in installing the stairway is expensive and time consuming.

In another type of prior art construction, there is provided a stairway which is attached to the top of the structure and which slopes downwardly away from the tank and is anchored to the ground at a substantial distance from the structure. This construction is cumbersome and occupies an excessive amount of ground space.

Other previous stairway constructions have consisted of a first stringer, either attached to or spaced from the structure wall, which conformed to the curvature thereof, with a second stringer horizontally spaced therefrom. Between the stringers is interposed a plurality of stairs forming the steps of the stairway. The disadvantage of this type of stairway is that since the stringers conform to the curvature of the circular structure they must be either custom built or prefabricated for circular structures of fixed diameter. Therefore, it would be a decided improvement over the prior art to have a stairway system which utilized modular component sections, which could be prefabricated to fit circular structures of varying diameters, and which could be conveniently and inexpensively assembled and installed on the structure.

U.S. Pat. No. 4,143,740 discloses a stairway with pre-fabricated straight modular component sections which can be installed on circular structures of different diameter. This patent, however, requires that each modular stairway section be joined to the next successive section through the use of preformed splice plates. Additionally, the patent discloses the use of braces attached at a first end to a brace bracket formed from a substantially triangular shaped metal plate with a flange formed on the front face thereof and attached at the second end to the sidewall of the circular structure. The braces must be preformed at the second end to an angle which allows the second end to rest substantially against the sidewall of the circular structure. As will be appreciated, as the radius of the circular structures to which this modular stairway changes (i.e. when the modular stairway is to be installed on several differently sized circular structures), the angle, and possibly the length, of the brace must be adjusted in order to achieve a maximum bracing effect. This necessitates additional labor and material expense associated with the installation of such modular stairway system.

The present invention does away with the splice plate used in U.S. Pat. No. 4,143,740 by providing modular stairway sections which have, integral therewith, stringer extensions which are adapted for joining to the stringer extensions of successive stairway sections. The present invention also does away with the triangular shaped plate and flange by using, in conjunction with the brace of U.S. Pat. No. 4,143,740, additional horizontal and vertical brace members which provide further support for the pre-fabricated stairway.

Accordingly, a primary object of this invention is to provide a practical stairway system which utilizes prefabricated straight modular component sections which can be installed on circular structures of different diameter and therefore different radii of curvature in either a clockwise or counterclockwise direction.

Another object is to provide a stairway system which can be easily and inexpensively manufactured, shipped disassembled and easily assembled and installed on a circular structure or other structure having curved or non-linear walls, with a minimum of labor and without the necessity of welding.

A further object is to provide a stairway system in which individual components can be conveniently and economically replaced due to the sectional construction and bolted installation.

A still further object is to provide a stairway system in which the sectional components have dimensions and corresponding hole punchings that match the bolt spacings on standardized circular structures such as grain storage bins.

A related object is to provide a stairway system which is safer to climb than the ladder systems which are frequently utilized due to the lack of inexpensive prefabricated stairway systems.

SUMMARY OF THE INVENTION

The foregoing and other objects, advantages and features of the present invention may be achieved with a prefabricated modular stairway system comprising a plurality of first stringer means, a plurality of first extension means integral with the first stringer means for joining the first stringers, a plurality of second stringer means horizontally spaced from and parallel to the first stringer means, and a plurality of adjustable second extension means integral with the second stringer means for adjustably joining the second stringers such that the first and second stringers conform to the curvature of the structure. A plurality of stairs horizontally interposed between the first and second stringers and stair mounting means for securing the stairs to the first and second stringers are provided. Also provided are mounting bracket means for securing the first stringers to the structure and brace means for supporting the second stringer to the structure, whereby there is obtained a reversible sectional stairway system which can be easily installed on structures having curved or non-linear walls.

The stairway system may also be provided with a platform section and a plurality of balusters and handrails for mounting on the stairway and platform sections.

DETAILED DESCRIPTION OF THE PREFERRED EMBODIMENT

In accordance with the present invention, there is obtained a practical stairway system which utilizes prefabricated straight modular component sections and which can be easily assembled and installed on circular structures of different diameters and radii of curvature, or other structures having non-linear walls, in either a clockwise or counterclockwise direction.

Figure 2:
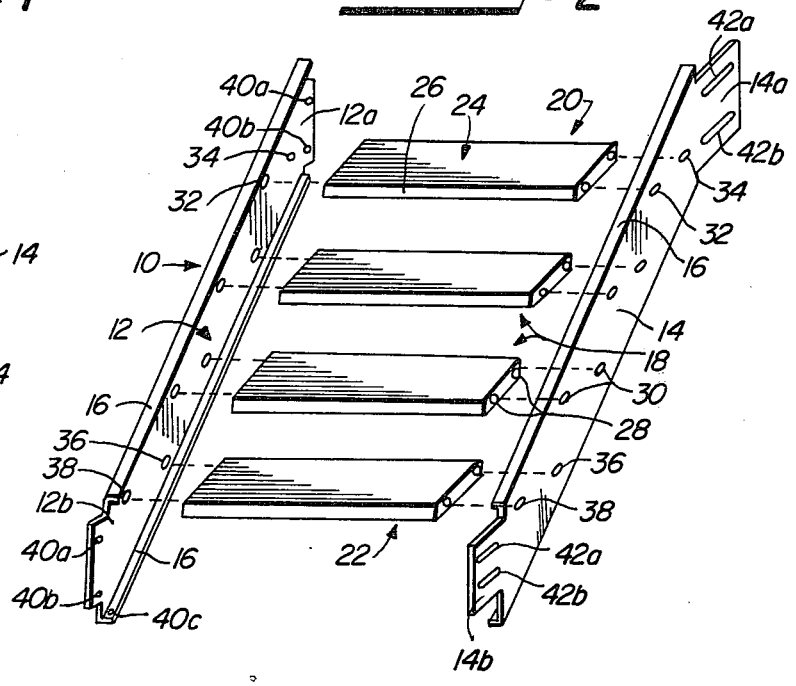
FIG. 2 is an exploded perspective view of a stairway section in accordance with this invention.

Referring now to the drawings with specific reference to FIG. 2, a stairway section 10 is comprised of a first stringer 12 and a second stringer 14 of sheet metal of uniform thickness and having inwardly turned flanges 16 formed on the top and bottom thereof. Each stringer contains, integrally therewith at each end, longitudinal extensions such as extensions 12*a* and 12*b* of stringer 12 and extensions 14*a* and 14*b* of stringer 14. First stringer 12 is disposed on the side of the stairway 10 nearest the wall of the circular structure when the stairway is constructed in counter-clockwise configuration. Second stringer 14 is disposed on the opposing or outer side of the stairway 10. Horizontally interposed between the first and second stringers 12, 14 are a plurality of intermediate stairs 18 along with an uppermost stair 20 and a bottommost stair 22. Each stair 18, 20, 22 is formed from sheet metal and is comprised of a tread portion 24 and a downward flange portion 26 which surrounds the tread portion 24 on all sides. The end flanges 26 on the stair are provided with holes 28 which align with corresponding holes 30 in the first and second stringers 12, 14. The stairs 18 are secured to the stringers 12, 14 by means of four bolts (not shown) which pass through holes 28 in stair 18 and holes 30 in stringers 12, 14. The holes 32, 34 for the top stair 20 and holes 36, 38 for the bottom stair 22 of each section are elongated for a purpose to be hereinafter described.

Substantially, any suitable material may be employed in fabricating the stringers 12, 14 and stairs 18, 20, 22, but galvanized steel has been found to be particularly satisfactory.

The extensions 12*a* and 12*b* of first stringer 12 include holes 40*a* and 40*b* for purposes hereinafter described. The extensions 14*a* and 14*b* of second stringer 14 include elongated holes 42*a* and 42*b* also for purposes fully described hereinafter. In the present invention, it is advantageous to contruct the extensions 12*a*, 12*b* and 14*a*, 14*b* of different length in order to conserve material costs.

As previously noted, second stringer 14 is the outermost striner when measured from the wall of the circular structure 160 (see FIG. 1) to which the modular stairway of the present invention is attached. Thus, extensions 14*a* and 14*b* should be sufficiently lengthy to permit successive second stringers to be joined at the overlap of the elongated holes 42*a, b*, as hereinafter described. Because the radius measured from the center of the circular structure 160 (see FIG. 1) to the first stringer 12 is less than the radius measured to the second stringer 14, the extensions 12*a* and 12*b* of the first stringer 12 may be shorter in length than that of the extensions 14*a* and 14*b* of the second stringer 14.

Figure 3:
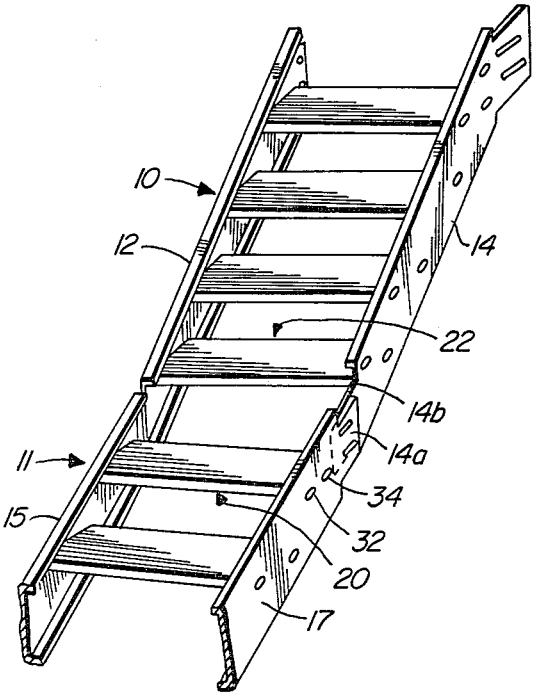
FIG. 3 is a partially exploded perspective view showing the connection of two adjacent stairway sections.

With reference to FIG. 3, adjacent stairway sections 10, 11 are joined by utilizing the extensions 12*a, b* and 14*a, b*.

The upper first stringer 12 and the lower first stringer 15 are joined by aligning the holes 40*a, b* of stringer 12 with the holes 40*a, b* of the stringer 25 and the stringer 12 is secured to the stringer 15 by means of bolts (not shown). The forward holes 28 of the bottommost stair 22 of the upper stairway section 10 is also aligned with hole 38 in the first stringer 12 and secured with bolts (not shown). The rearward hole 28 of the uppermost stair 20 of the lower stairway 11 is also aligned with hole 34 of the first stringer 15 and secured with bolts (not shown). The securing of the uppermost stair 20 and bottommost stair 22 to the first stringers 12, 15 is completed by means of bolts (not shown) which pass through hole 32 in lower first stringer 15 and the forward hole 28 in uppermost stair 20 of stairway section 11 and hole 36 in upper first stringer 12 and the rearward hole 28 in the bottommost stair 22 of stairway section 10.

As mentioned, the extensions 14*a, b* of the second of stringer are provided with elongated holes 42*a, b* for joining the upper and lower second stringers 14, 17. The second stringers 14, 17 are joined by aligning the slots 42*a, b* of the second stringer 14 with slots 42*a, b* of the second stringer 17. The rearward hole 28 of the uppermost stair 20 of the lower stairway section 11 is also aligned with slot 34 of the second stringer 17 and secured with bolts (not shown). The forward hole 28 of the bottommost stair 22 of the upper stairway section 10 is also aligned with slot 38 in the second stringer 14 and secured with bolts (not shown). The securing of the uppermost stair 20 and bottommost stair 22 to the second stringers 14, 17 is completed by means of bolts (not shown) which pass through hole 28 in uppermost stair 20 of stairway section 11 and hole 36 in second stringer 14 and the rearward hole 28 in the bottommost stair 22 of stairway section 10.

In the embodiment described above, the uppermost and bottommost stairs 20, 22 of each stairway section 10 are secured to the stringers 12, 14, 15, 17 using bolts. It will be appreciated by anyone skilled in the art that the uppermost and bottommost stairs 20, 22 could also be independently secured in the same manner as intermediate stairs 18.

As many stairway sections as are necessary for the required height are joined in the foregoing manner. The securing bolts (not shown) described above are only loosely tightened until the stairway system is installed on the structure. This allows the bolts to be slideably positioned in the elongated holes of the extensions 14*a, b* thereby allowing the stairway system to adjust to the curvature of the circular structure, or other structure having non-linear walls, during installation.

Figure 4:
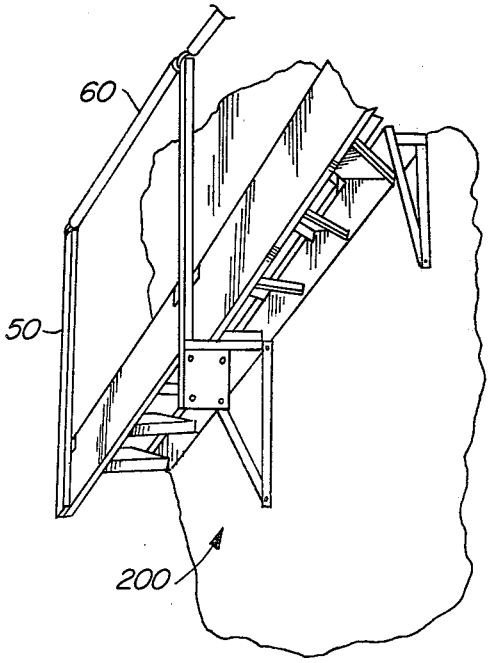
FIG. 4 is a perspective view of the mounting means of the present invention.

As shown in FIG. 4, the stairway system is also provided with balusters 50, handrails 60 and brace 200 formed of metal angle, rectangular or square metal plate or metal tube.

Figure 5:
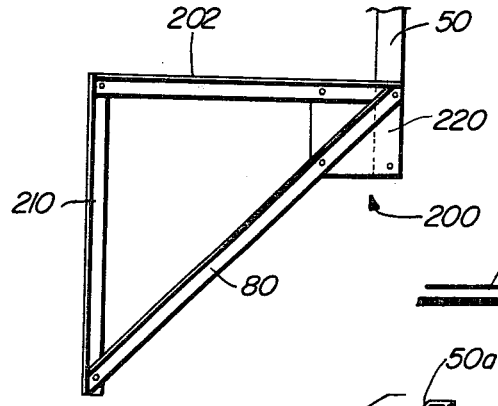
FIG. 5 is a side view of the mounting means of the present invention.

FIG. 5 depicts the brace 200 together with a portion of the baluster 50. The brace 200 comprises a horizontal brace 202, a vertical brace 210, angled brace 80, and brace plate 220.

Figure 6:
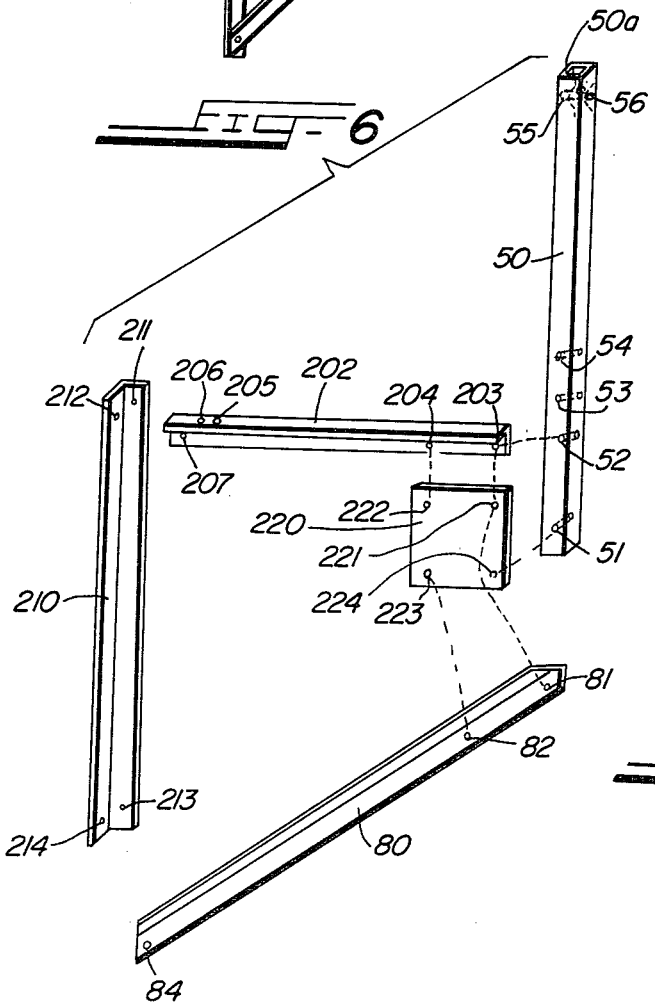
FIG. 6 is an exploded perspective view showing the mounting means and a baluster.

As further shown in FIG. 6, which is an exploded view of FIG. 5, the horizontal brace 202 includes holes 203, 204, 205, 206 and 207. The vertical brace 210 includes holes 211, 212, 213, and 214; the brace 80 includes holes 81, 82 and 84; and the brace plate 220 includes holes 221, 222, 223, and 224. Finally, the baluster 50 includes holes 51, 52, 53, 54 and may include holes 55 or 56 or both. Construction of the brace 200 together with baluster 50 proceeds as follows (the sequence of which is immaterial to the present invention).

The hole 52 of the baluster 50, hole 221 of brace plate 220, hole 203 of the horizontal brace 202, and hole 81 of angled brace 80 are aligned and secured with a bolt (not shown). The hole 204 of horizontal brace 202 is aligned with hole 222 of brace plate 220 and secured with a bolt (not shown). The hole 207 of horizontal brace 202 is aligned with the hole 211 of vertical brace 210 and secured with a bolt (not shown). The hole 51 of the baluster 50 is aligned with hole 224 of brace plate 220 and secured with a bolt (not shown). Finally, holes 82 and 84 of angled brace 80 are aligned with hole 223 of brace plate 220 and 213 of vertical brace 210, respectively, and secured with bolts (not shown).

The brace 200, so constructed, may then be attached to first and second stringers. Thus, holes 53 and 54 of baluster 50 are aligned with elongated holes 42*a, b* of second stringer extension 14*b* and secured with bolts. (It should be appreciated that such aligning and securing may be done at the time the extension 14*b* of upper second stringer 14 is aligned and secured with the extension 14*a* of lower second stringer 17, as previously discussed with respect to FIG. 3.) Attachment of brace 200 to first stringer 12 occurs by aligning hole 205 of horizontal brace 202 with hole 40*c* of extension 12*b* and secured by means of a bolt (not shown). Thereafter, vertical brace 210 may be attached to the walls of circular structure 160 by means of screws or bolts (not shown) projecting through holes 212 and 214 of brace 210 and into the side wall of structure 160.

Figure 7:
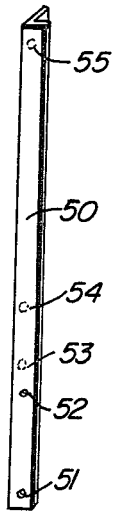
FIG. 7 is an alternative baluster.

The baluster 50 shown in FIG. 6 is depicted as a metal pipe or tube with square or rectangular cross-section. It should be appreciated that metal angle is also usable as the baluster 50. Thus, FIG. 7 depicts a baluster made from metal angle and includes holes 51, 52, 53, 54, and 55.

Figure 8:
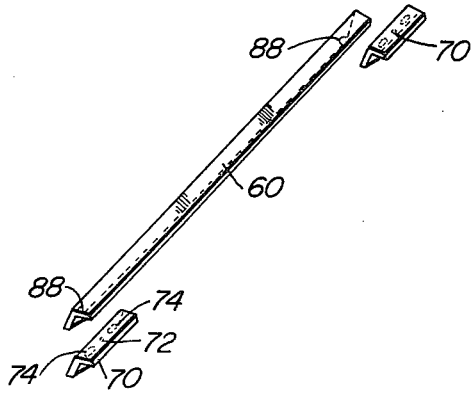
FIG. 8 is a perspective view of a handrail and handrail splices.

In the event that the baluster 50 is made from metal angle (see FIG. 7), the handrail 60 may be mounted to the balusters 58 by utilizing two handrail splices 70 comprised of metal angle. (See FIG. 8.) The handrail splice 70 is provided with a central hole 72 and a slot 74 on each end thereof. The handrail splice 70 is secured to the baluster 50 by means of a bolt (not shown) which passes through hole 72 in the handrail splice 70 and hole 55 in the baluster 50. The handrail 60 is then secured to the two handrail splices 70 by means of two bolts (not shown) which pass through holes 88 in the handrail 60 and slots 74 in handrail splices 70.

Figure 9:
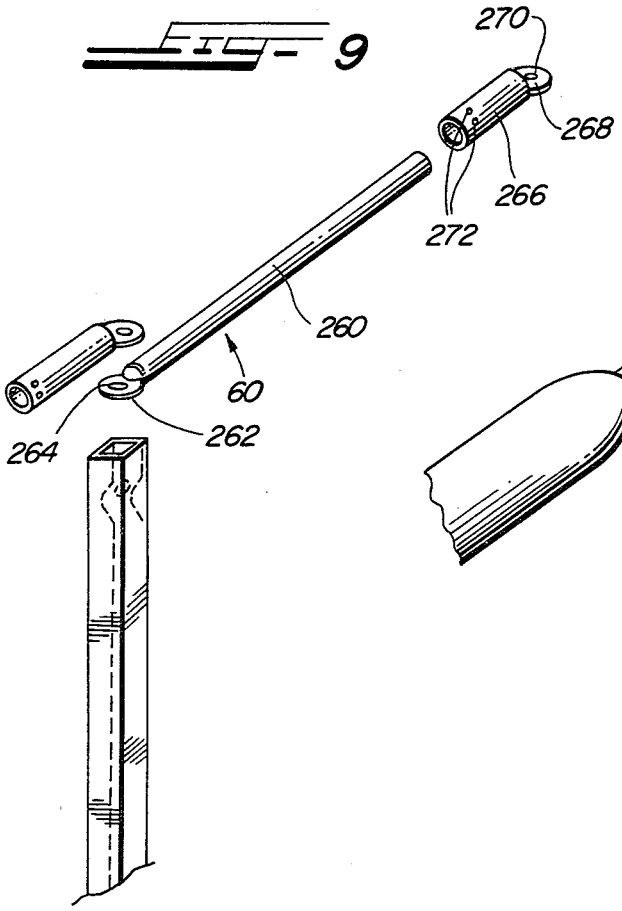
FIG. 9 is an exploded perspective view of alternative baluster and handrail configurations.

Alternatively, the handrail 60 may be made of metal tubing as shown in FIG. 9. There it can be noted that the handrail 60 is comprised of a length 260 of metal tubing which is flattened at one end thereof to form flat 262. Flat 262 includes hole 264. The handrail 60 additionally includes a length 266 of metal tube of a diameter somewhat larger than that of length 260. Length 266 also contains a flat 268 which includes a hole 270. Holes 272 are included in the length 266. The handrail 60 is constructed by placing length 266 on length 260 and lightly securing length 266 to length 260 by using set screws (not shown) inserted in holes 272. The hole 264 of flat 262 is aligned with hole 55 of baluster 50 (see FIG. 6 and FIG. 7) and secured with a bolt (not shown). Thereafter, the length 266 is, in a telescoping manner, aligned with hole 55 of the next adjacent baluster 50 and length 266 is secured to baluster 50 with a bolt (not shown). The set screws (not shown) in holes 272 of length 266 are then tightened. It should, of course, be appreciated that when constructing successive sections of the modular stairway of the present invention flats 262 and 268 of the successive lengths 260 and 266 overlap.

Figure 10:
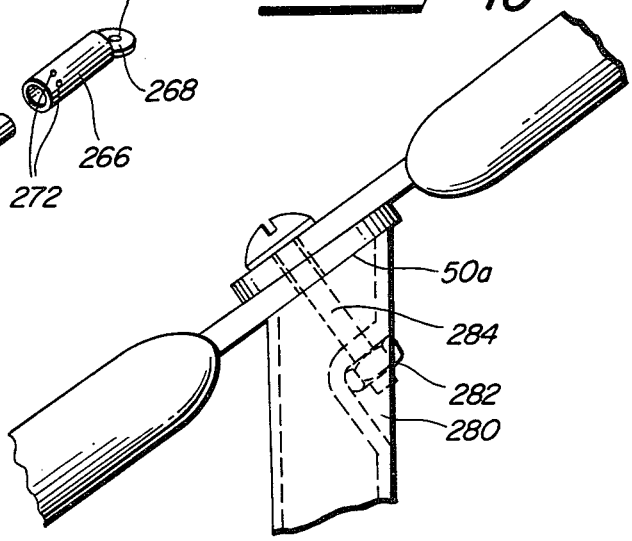
FIG. 10 is a detailed view of ends of the handrail attached to the baluster.
Figure 12:
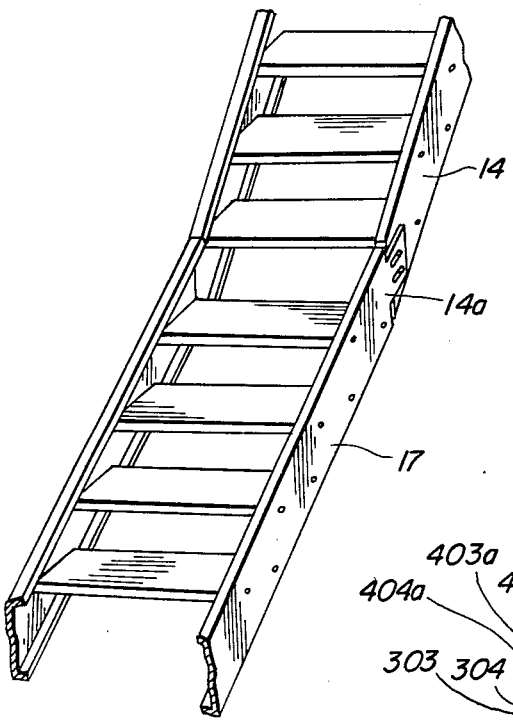
FIG. 12 is another view of the stairway showing the connection of two adjacent stairway sections.

In the event that baluster 50 is constructed of metal tubing, as described above, it may be advantageous to form end 50*a* (see FIG. 6 and FIG. 10) of baluster 50 at an angle. In order to secure the flats 262 and 268 to baluster 50, baluster 50 is provided with detent 280 which is adapted to receive nut 282 of bolt 284. Alternatively, if the metal tubing, as depicted in FIG. 6, is used as the baluster 50, it is possible to attach the handrail 60 to this baluster 50 by aligning holes 264 and 270 of flats 262 and 268, respectively, with a hole 55 formed in the side of the baluster 50. Attachment then proceeds as previously described.

Substantially, any suitable material may be employed in fabricating the handrail 60, balusters 50, handrail splice 70, and brace 200, but galvanized steel has been found to be especially satisfactory.

Figure 11:
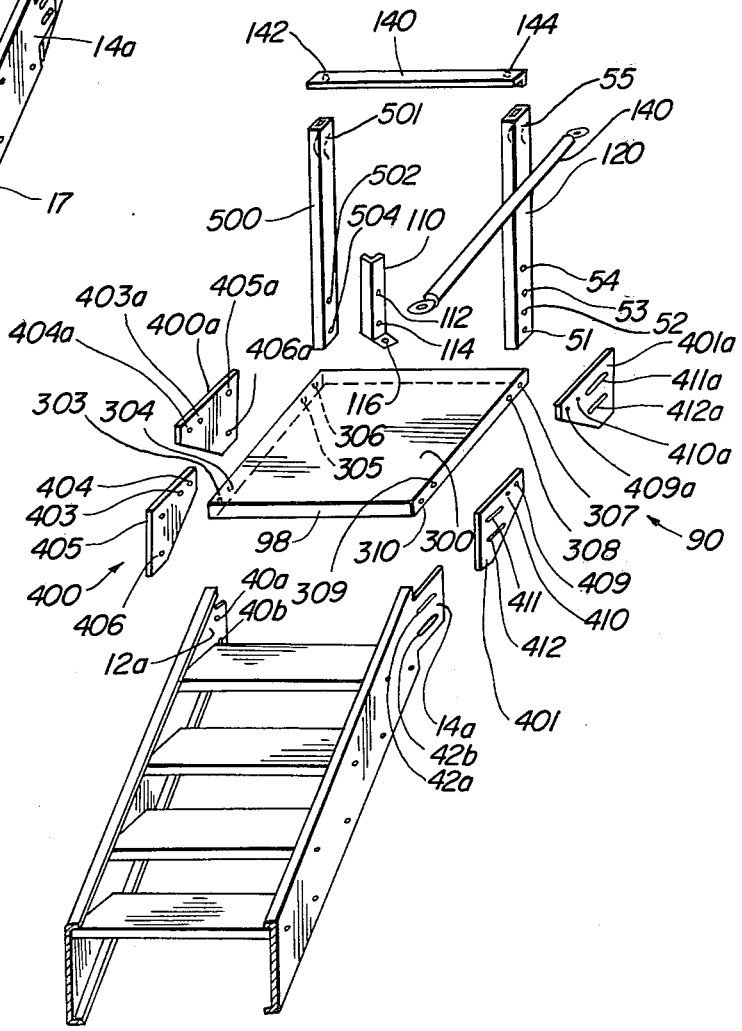
FIG. 11 is a partially exploded perspective view of a top stairway section and the platform section.

As shown in FIG. 11, a platform section 90 is provided at the top of the stairway system. The platform section 90 is compromised of a deck 300 of sheet metal of uniform thickness and having downwardly turned flanges 98 formed on the four sides thereof.

Substantially, any material may be employed in fabricating the deck 300, but galvanized steel has been found to be especially satisfactory.

The deck 300 is secured to the first stringer 12 of the stairway section 10 by means of a corner bracket 400 formed of metal plate. The corner bracket 400 is secured to deck 300 by means of two bolts (not shown) which pass through holes 403 and 404 in corner bracket 400 and holes 303 and 304 in deck 300. Holes 405 and 406 of corner bracket 400 are aligned with holes 40*a, b*, respectively, of extension 12*a* and secured with bolts (not shown). The deck 300 is secured to the second stringer 14 of the stairway system by means of two bolts (not shown) which pass through holes 409, 410 in corner bracket 401 and holes 309, 310 in deck 300. Slots 411 and 512 of corner bracket 401 are aligned with slots 42*a, b* of extension 14*a* and are also aligned with holes 54, 53, respectively, of baluster 50 and secured with bolts (not shown).

Corner bracket 400*a* is secured to the deck 300 by bolts (not shown) passing through holes 305 and 306 of deck 300 and 404*a* and 403*a* of bracket 400*a*.

Support bracket 110 is secured to the deck 300 by means of bolts (not shown) passing through holes 112 and 114 of bracket 110 and holes 405*a* and 406*a* of bracket 400*a*.

Corner bracket 401*a* is secured to the deck 300 by means of bolts (not shown) passing through holes 409*a* and 410*a* of bracket 401*a* and holes 308 and 307, respectively, of deck 300. Baluster 120 is secured to deck 300 by bolts (not shown) passing through holes 54, 53 in baluster 120 and slots 411*a* and 412*a*, respectively, of bracket 401*a*.

The support bracket 110 is further secured to horizontal brace 202 by means of a bolt (not shown) which passes through hole 116 in bracket 110 and hole 205 in horizontal brace 202. The brace 200, as previously described, is attached to the baluster 120 by aligning holes 52 and 51 with holes 221 and 224, respectively, of brace plate 220 and thereafter securing the respective components with bolts (not shown).

In the event it is desired to construct a catwalk or platform around all or part of the circular structure 160 out of several sections of deck 300, this may easily be accomplished. Thus, a first deck section is constructed by attaching corner brackets 400, 400*a*, 401, and 401*a* to the deck 300. A second deck section is similarly constructed. The holes 112 and 114 of support bracket 110 are aligned with the holes 405*a* and 406*a*, respectively, of the bracket 400*a* and secured by bolts (not shown).

Also, holes 54 and 53 of baluster 120 are aligned with slots 411*a* and 412*a* of bracket 401*a* and slots 411 and 412 of bracket 401. The baluster 120 and brackets 401 and 401*a* are secured with bolts (not shown). The brace 200 is secured to the deck 300 as previously described. Handrails may also be installed in a manner similar to that already described.

Furthermore, it may be advantageous in certain situations to construct a catwalk which only partially encircles the structure 160. Accordingly, after the final deck section is constructed, the holes 112 and 114 of support bracket 110 are aligned with holes 502 and 504 of the baluster 500 and with the holes 405*a* and 406*a*, respectively, of the bracket 400*a*. The bracket 110, baluster 500 and bracket 400*a* are secured with bolts (not shown). Handrail 140 is secured to baluster 500 by means of a bolt (not shown) which passes through hole 142 in handrail 140 and hole 501 in baluster 500; and to baluster 120 by means of a bolt (not shown) which passes through hole 144 in handrail 140 and hole 55 in baluster 120. Handrail 140 is secured to baluster 120 by means of a bolt (not shown) as previously described with respect to FIGS. 6 through 10. It will be appreciated that the ends of each successive deck section, at the outermost point thereof, will be spaced somewhat apart dependent upon the curvature of the circular structure 160. It will also be appreciated that the baluster 50 of FIG. 7 and the handrail 60, including splices 70, may be easily substituted for the balusters 500 and 120 and the handrail 140 shown in FIG. 11.

Figure 1:
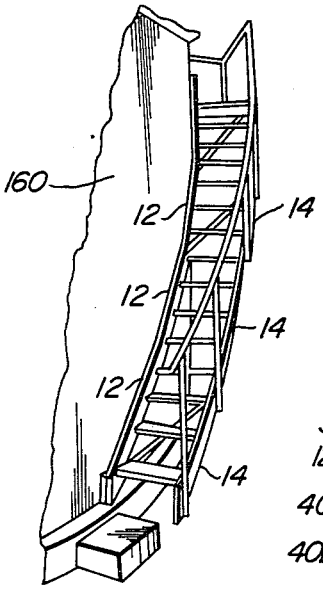
FIG. 1 is a perspective view of the novel stairway of the present invention mounted in a counter-clockwise direction on a circular structure.

Referring to FIGS. 1 and 5, the deck is secured to the structure 160 by means of the brace 200, in a manner as previously described.

The stairway sections as described above are mounted on the non-linear structure in a counterclockwise direction. If it is desired to mount the sections in a clockwise direction, this is accomplished by disposing the second stringer 14 on the side of the stairway 10 farthest from the wall of the structure so that flanges 16 are directed away from the wall of the structure, with the first stringer 12 being disposed such that the flanges 16 are immediately adjacent the circular structure 160. Thereafter, construction proceeds as described above.

In the embodiment shown in FIGS. 1–12, the stairway system of this invention is shown in connection with a cylindrical storage bin. However, it may also be employed with structures having other non-linear wall structures such as oval or ellipsoidal structures, and certain polygonal structures as well.

Accordingly, the modular stairway apparatus of this invention fulfills a significant role in overcoming the disadvantages of prior art efforts to prefabricate stairways for structures having curved or non-linear walls. In particular, it provides a practical stairway system which utilizes prefabricated straight modular component sections which can be installed on circular structures of different diameter and therefore different radii of curvature in either a clockwise or counterclockwise direction.

In addition, the stairway system can be easily and inexpensively manufactured, shipped disassembled and easily assembled and installed with a minimum of labor without the necessity of welding. Furthermore, the individual components can also be conveniently and economically replaced when necessary due to the sectional construction and bolted installation.

Moreover, the sectional components can have dimensions and corresponding hole punchings which match the normal bolt spacings on standard circular structures such as grain storage bins.

At the same time a stairway system is obtained which is safer to climb than the ladder systems which are frequently utilized due to the lack of inexpensive convenient prefabricated stairway systems.

We claim:

1. A modular stairway system for structures having non-linear walls comprising:

a plurality of first stringer means each having first connecting means integral therewith at opposite ends thereof for joining the first stringers;

a plurality of second stringer means horizontally spaced from and substantially parallel to the first stringer means each having adjustable second connecting means integral therewith at opposite ends thereof for adjustably joining the second stringers such that the combination of first and second stringers conform to the curvature of the structure;

a plurality of stairs horizontally interposed between the first and second stringers;

mounting means for securing the first and second stringers to the structure;

whereby the stairway system may be easily installed on structures having non-linear walls.

2. An apparatus, as claimed in claim 1, wherein the adjustable second connecting means comprises an integral metal extension having spaced apart horizontally elongated holes.

3. An apparatus, as claimed in claim 2, wherein the first connecting means comprises an integral metal extension having spaced apart holes.

4. An apparatus, as claimed in claim 1, wherein spacing of the spaced holes conform to the normal bolt spacing on standardized structures having non-linear walls.

5. An apparatus, as claimed in claim 1, further comprising:

a platform section;

a platform connecting means for joining the platform section to the first and second stringers;

a platform mounting means for securing the platform to the structure and for supporting the platform to the structure.

6. An apparatus, as claimed in claim 5, further comprising:

a plurality of balusters secured to the second stringers and platform section; and a plurality of handrails adjustably secured to the balusters.

7. An apparatus, as claimed in claim 1 or 5, wherein said mounting means comprises a horizontal brace attachable to said first stringer, a vertical brace attached to said horizontal brace and attachable to the non-linear wall of the structure, a brace plate attached to said horizontal brace, an angled brace attached to said brace plate and further attached to said vertical brace, and a baluster attached to said horizontal brace and attachable to said second stringer.

* * * * *

UNITED STATES PATENT AND TRADEMARK OFFICE

CERTIFICATE OF CORRECTION

PATENT NO. : 4,355,700

DATED : October 26, 1982

INVENTOR(S) : Wesley D. Matthews; Floyd G. Matthews

It is certified that error appears in the above—identified patent and that said Letters Patent is hereby corrected as shown below:

Col. 4, line 27, "25" should read --15--.

Col. 6, line 67, "512" should read --412--.

Signed and Sealed this

*First* Day of *March 1983*

[SEAL]

*Attest:*

GERALD J. MOSSINGHOFF

*Attesting Officer*

*Commissioner of Patents and Trademarks*